US011327422B2

(12) United States Patent
Onodera

(10) Patent No.: US 11,327,422 B2
(45) Date of Patent: May 10, 2022

(54) COOLING DEVICE AND IMAGE FORMING SYSTEM

(71) Applicant: CANON KABUSHIKI KAISHA, Tokyo (JP)

(72) Inventor: Shinichi Onodera, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/334,298

(22) Filed: May 28, 2021

(65) Prior Publication Data

US 2021/0382418 A1 Dec. 9, 2021

(30) Foreign Application Priority Data

Jun. 9, 2020 (JP) ..... JP2020-100037

(51) Int. Cl.

| | |
|---|---|
| ***G03G 15/20*** | (2006.01) |
| ***G03G 15/00*** | (2006.01) |
| ***G03G 21/16*** | (2006.01) |
| ***G03G 21/20*** | (2006.01) |

(52) U.S. Cl.

CPC ..... *G03G 15/2017* (2013.01); *G03G 15/2021* (2013.01); *G03G 15/2032* (2013.01); *G03G 15/6573* (2013.01); *G03G 21/1685* (2013.01); *G03G 21/20* (2013.01); *G03G 2215/2003* (2013.01)

(58) Field of Classification Search

CPC ..... G03G 15/2017; G03G 15/2021; G03G 15/2032; G03G 15/6573; G03G 21/1685; G03G 21/20; G03G 2215/2003

See application file for complete search history.

(56) References Cited

U.S. PATENT DOCUMENTS

2014/0186080 A1* 7/2014 Ikeda ..... G03G 15/6529 399/341
2014/0233996 A1* 8/2014 Ikeda ..... G03G 21/20 399/341
2014/0334858 A1* 11/2014 Miyagawa ..... G03G 15/2017 399/341

FOREIGN PATENT DOCUMENTS

JP 2002-252475 9/2002

* cited by examiner

*Primary Examiner* — Joseph S Wong
(74) *Attorney, Agent, or Firm* — Venable LLP

(57) ABSTRACT

A sheet cooling device includes a main assembly, a cooling unit, drawable out of the main assembly with respect to a drawing direction and a restricting member. The restricting member is positionable in a first position where the cooling unit is restricted from drawing out of the main assembly and in a second position lower than the first position where said restricting member opposes to an installation surface on which the sheet cooling device is installed.

9 Claims, 11 Drawing Sheets

(a)

(b)

(a)

(b)

COOLING DEVICE AND IMAGE FORMING SYSTEM

FIELD OF THE INVENTION AND RELATED ART

The present invention relates to a sheet cooling device for cooling sheets and an image forming system cooling device for equipped with the cooling device.

Conventionally, an image forming apparatus equipped with casters attached to the four corners of the floor surface and a tip resistant member that can be rotated around the support shaft of the casters has been proposed (Japanese Laid-Open Patent Application (JP-A) 2002-252475). The tip resistant member has an abbreviated fan shape and can be fixed in a standby position where it is hidden in the floor of the image forming apparatus and in a functional position where it protrudes from the floor to prevent the image forming apparatus from tipping over.

However, the tip resistant member disclosed in JP-A 2002-252475, is stored in a standby position hidden in the floor when not in use, so there are cases where a user forgets to set the tip resistant member in the functional position when it is needed. When such a tip resistant member is installed in a sheet cooling device having a cooling unit that cools the sheets, if the cooling unit is drawn out of the device while the tip resistant member is forgotten to be set in the functional position, there is a liability that the weight of the cooling unit causes the sheet cooling device itself to tilt.

Therefore, the purpose of the present invention is to provide a sheet cooling device and an image forming system equipped with the cooling device, which can reduce the forgetting to set the restricting member.

SUMMARY OF THE INVENTION

According to an aspect of the present invention, there is provided a sheet cooling device comprising: a main assembly; a cooling unit, drawable out of said main assembly with respect to a drawing direction, provided with a first belt, a second belt for forming a nip portion with said first belt to nip and feed a sheet and a heatsink in contact with an inner peripheral surface of said first belt; and a restricting member configured to be positionable in a first position where said cooling unit is restricted from drawing out of said main assembly and in a second position lower than the first position where said restricting member opposes to an installation surface on which said sheet cooling device is installed.

Further features of the present invention will become apparent from the following description of exemplary embodiments (with reference to the attached drawings)

Figure 2:
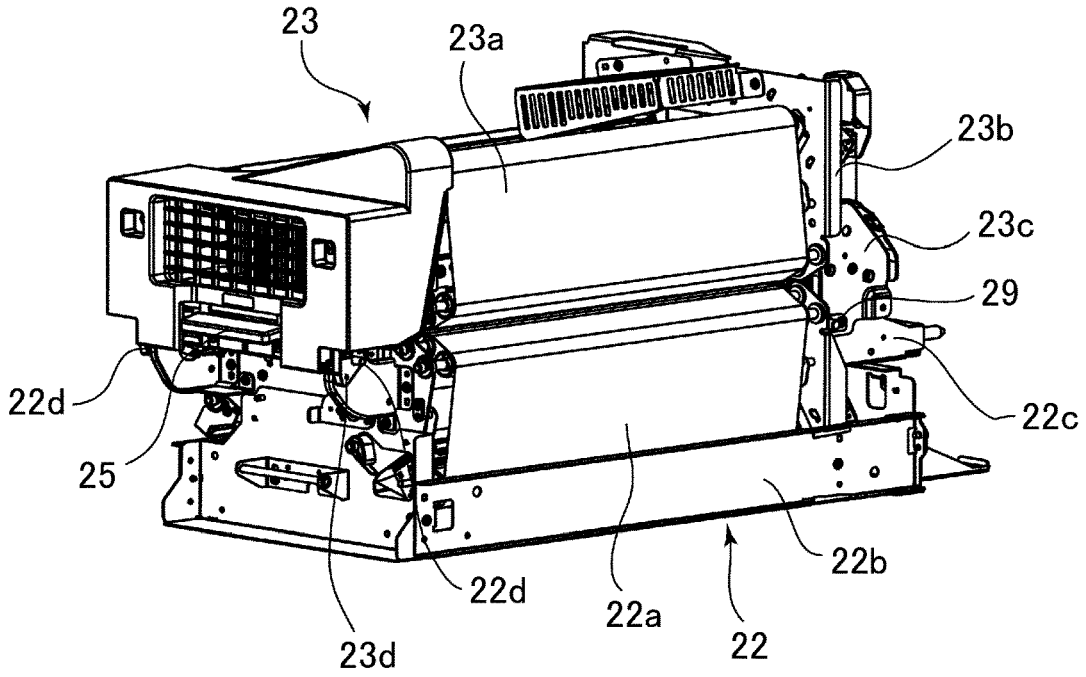
Figure 2:
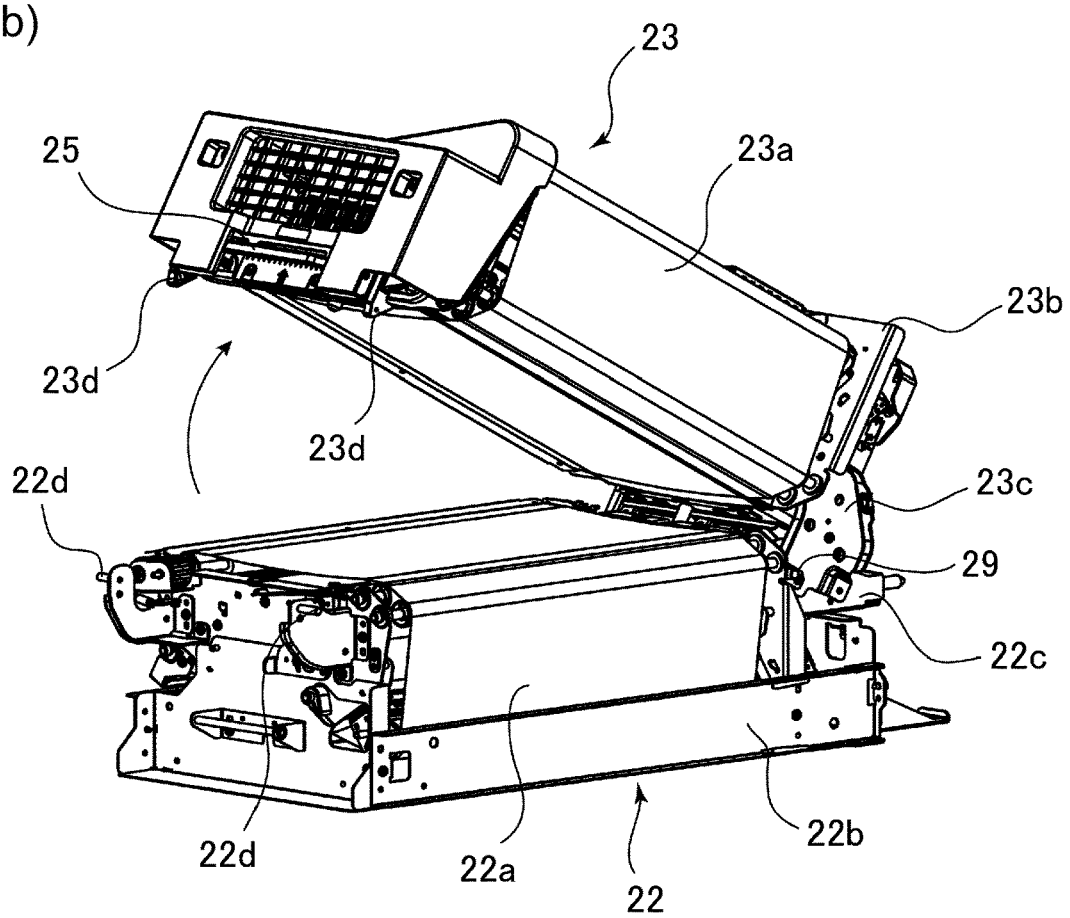

Part (a) of FIG. 2 is a perspective view showing a cooling unit, and part (b) of FIG. 2 is a perspective view showing a cooling unit with an upper unit opened.

Figure 3:
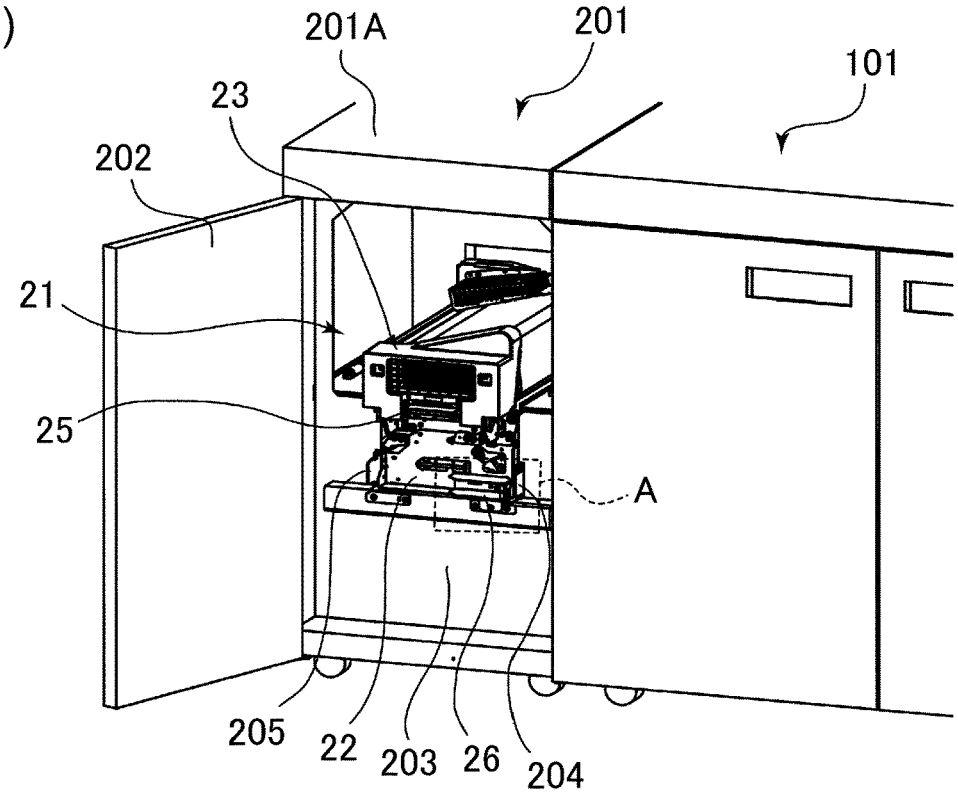
Figure 3:
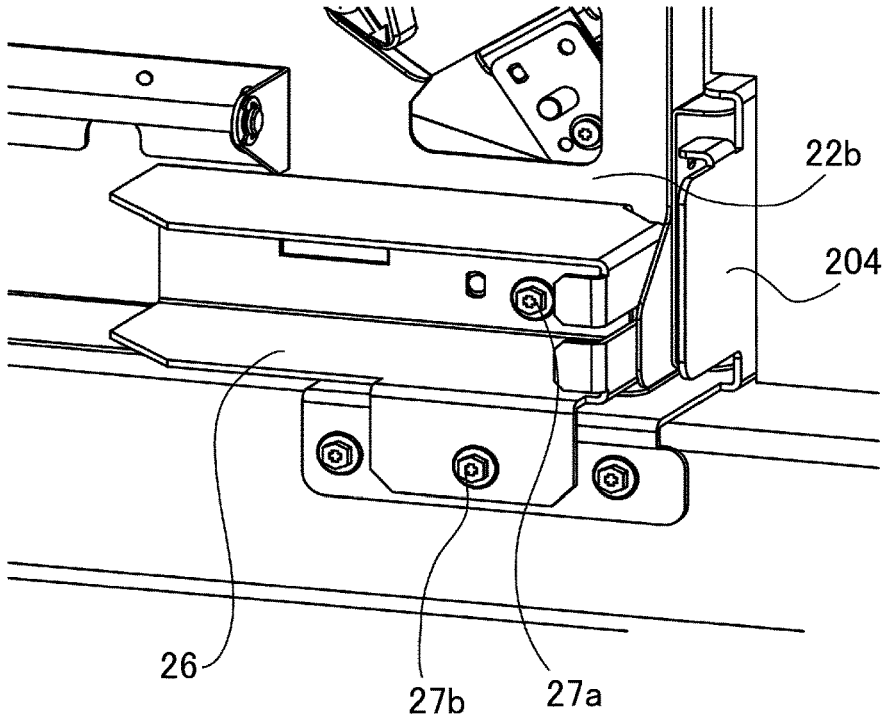

Part (a) of FIG. 3 is a perspective view showing a cooling unit, part (b) of FIG. 3 is an enlarged perspective view showing the dashed line A in part (a) of FIG. 3.

Figure 4:
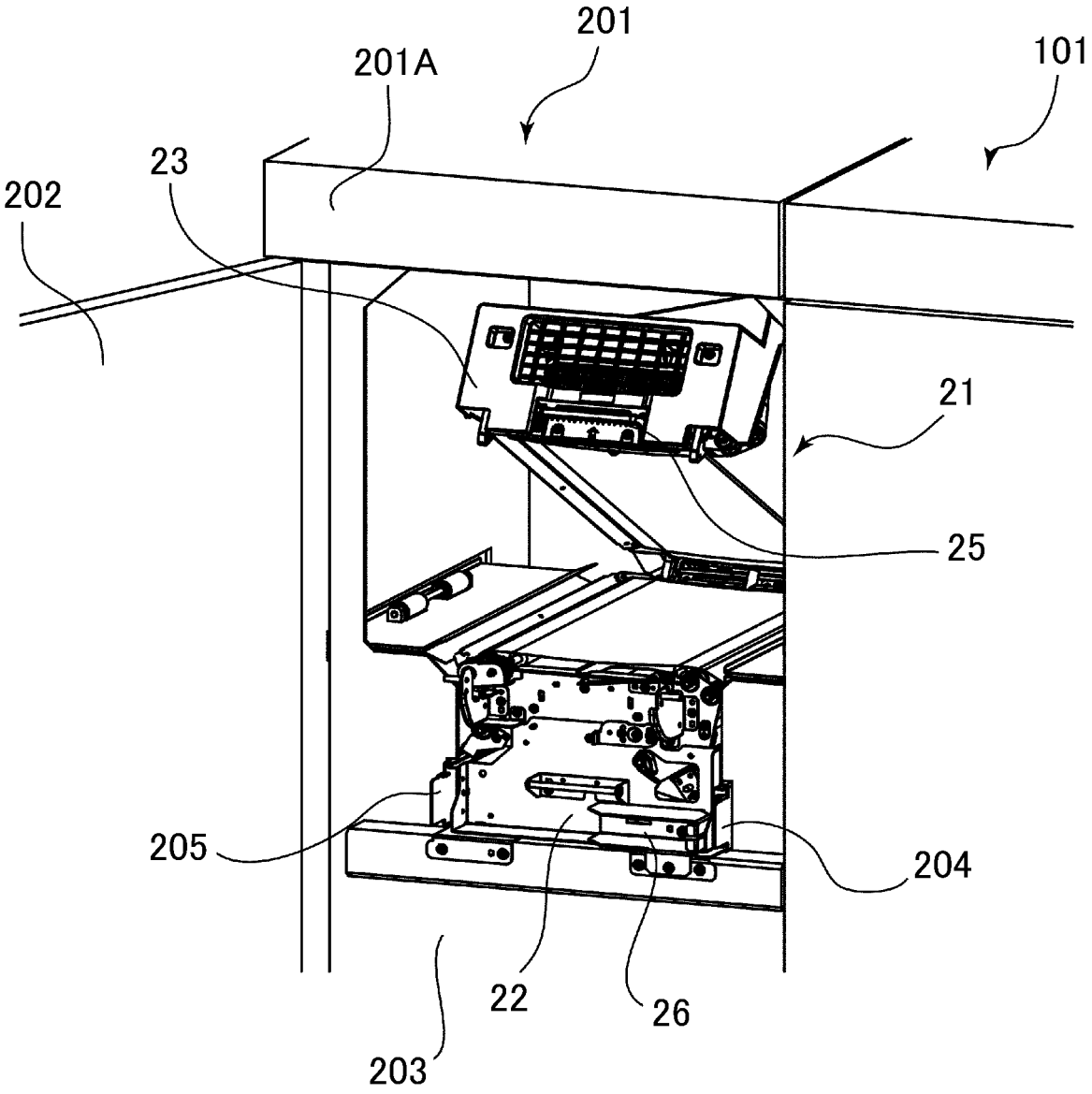

FIG. 4 is a perspective view showing a cooling unit.

Figure 5:
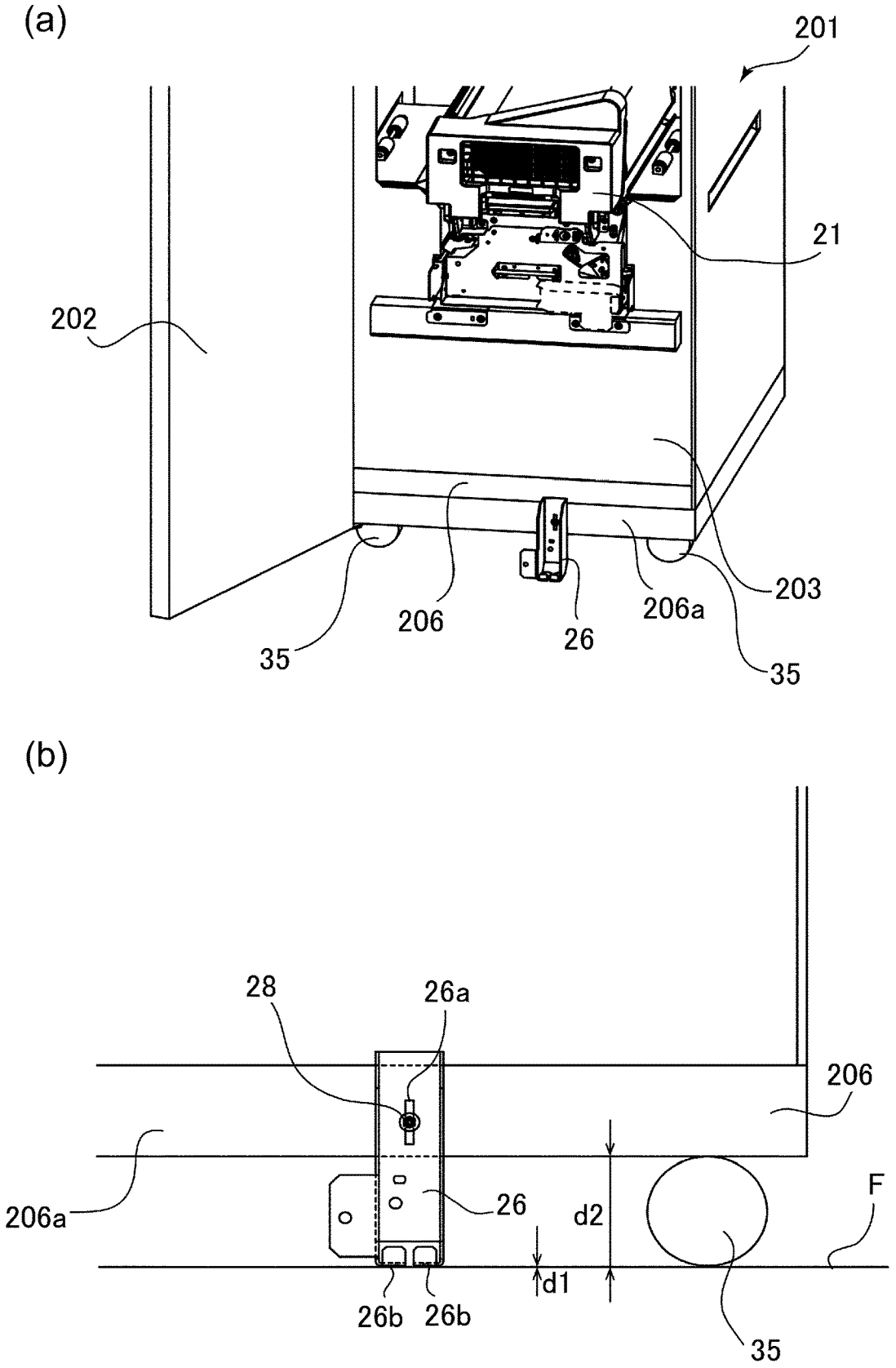

Part (a) of FIG. 5 is a perspective view showing a fixing member in a tip resistant position, and part (b) of FIG. 5 is a front view showing a fixing member.

Figure 6:
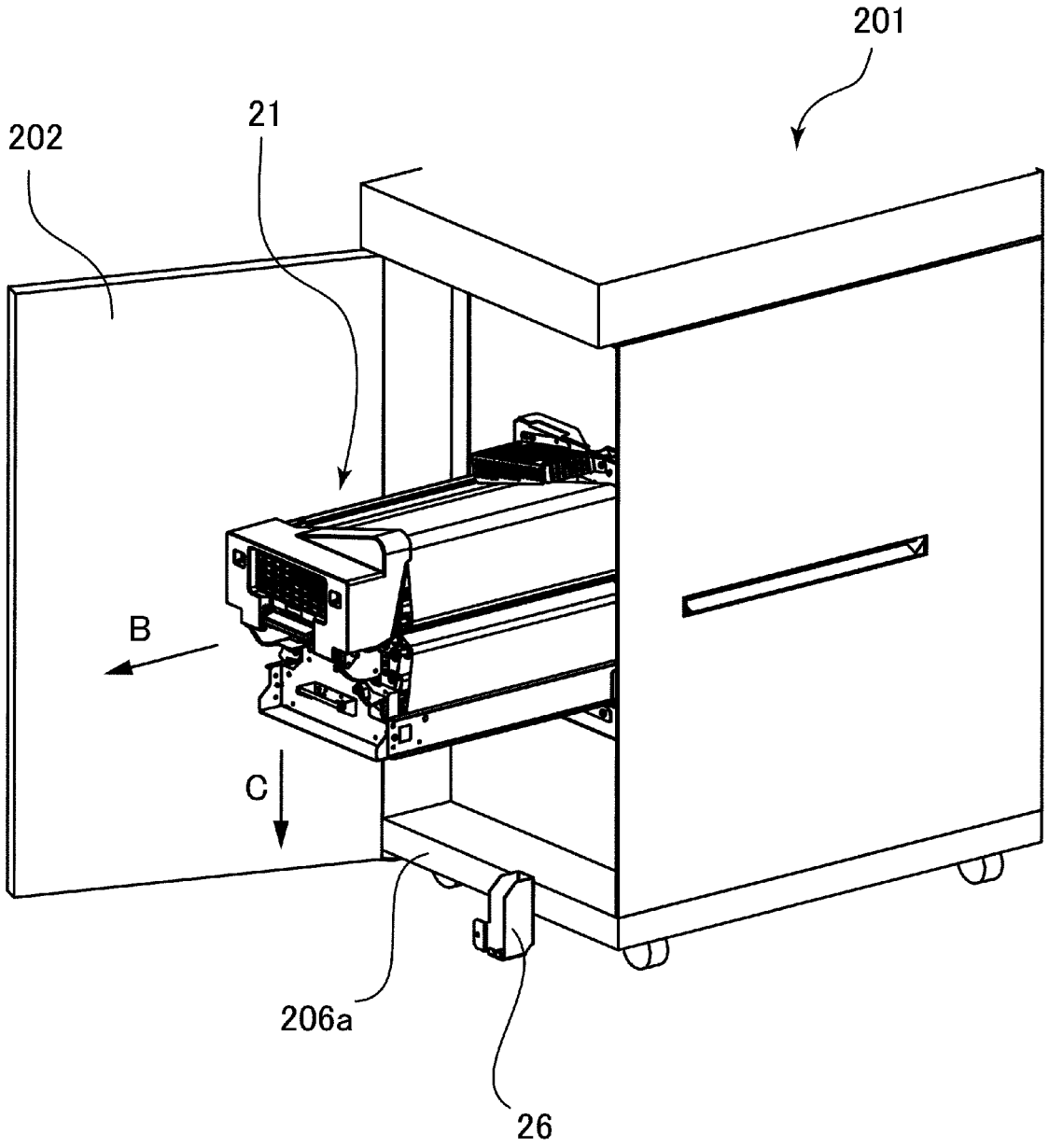

FIG. 6 is a perspective view showing a cooling system with a cooling unit drawn out.

Figure 7:
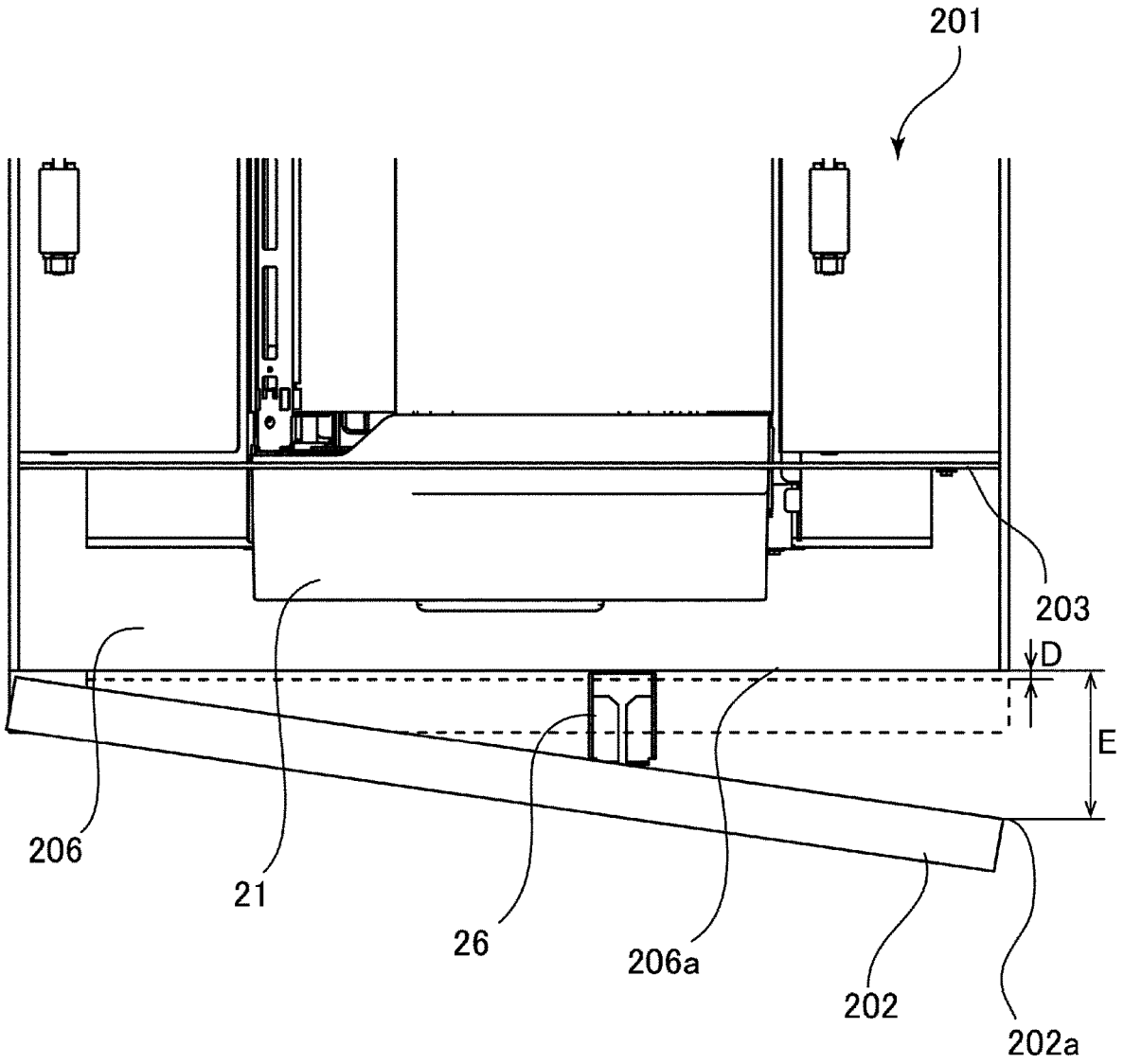

FIG. 7 is a plane view showing the relationship between a fixing member and a door.

Figure 8:
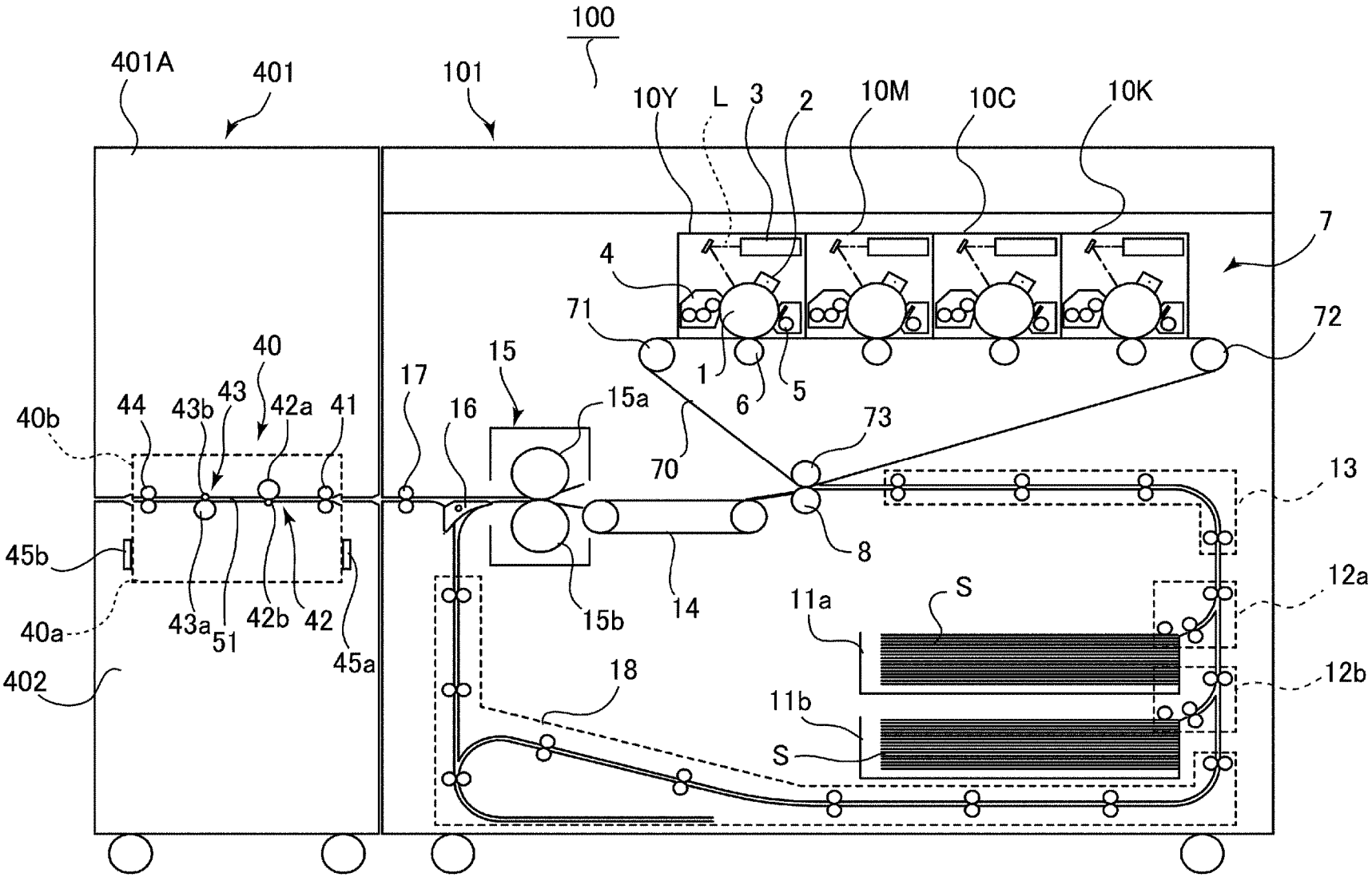

FIG. 8 is an overall schematic view showing an image forming system of a second embodiment of the present invention.

Figure 9:
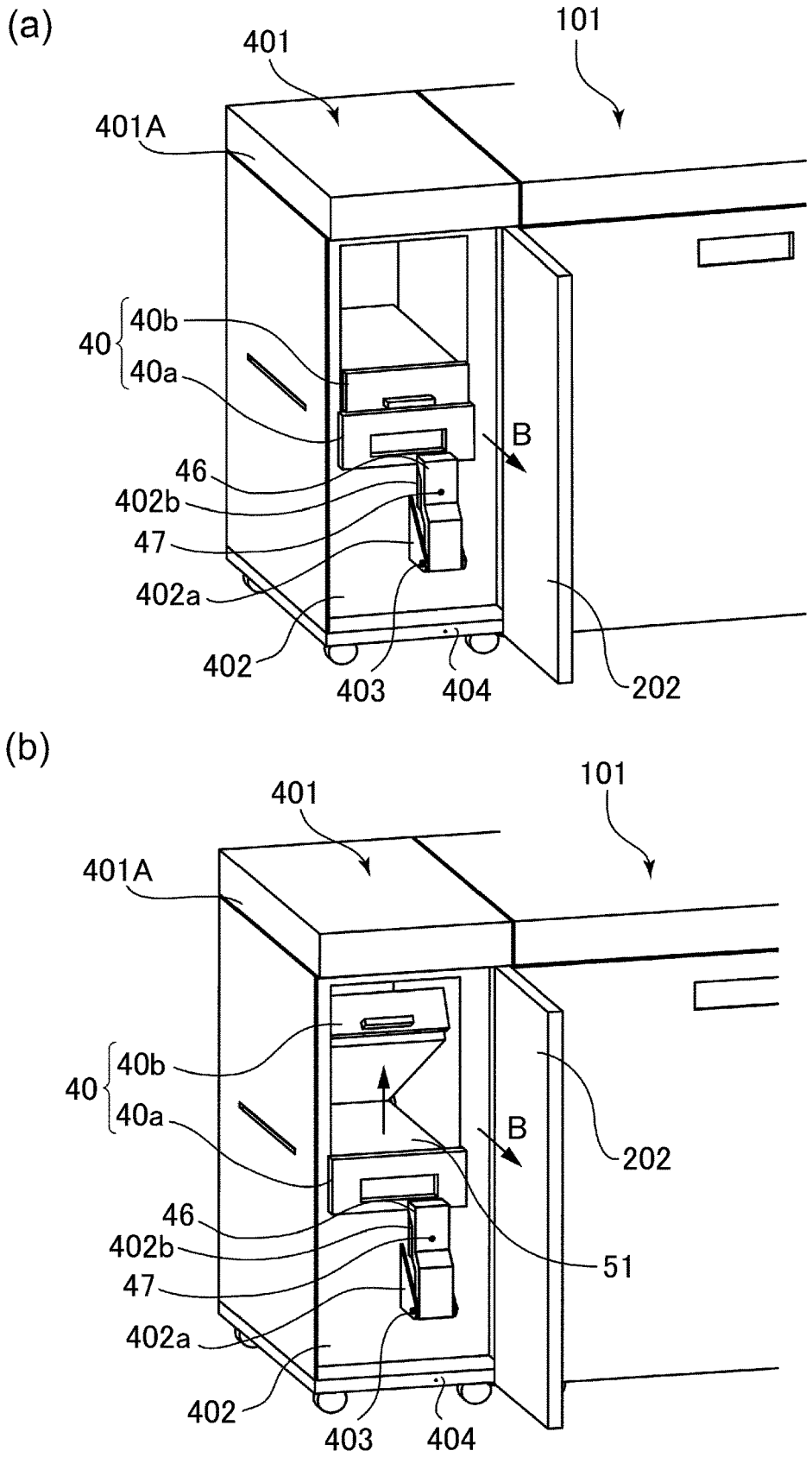

Part (a) of FIG. 9 is a perspective view showing a decurl device, and part (b) of FIG. 9 is a perspective view showing a decurl device with an upper unit opened.

Figure 10:
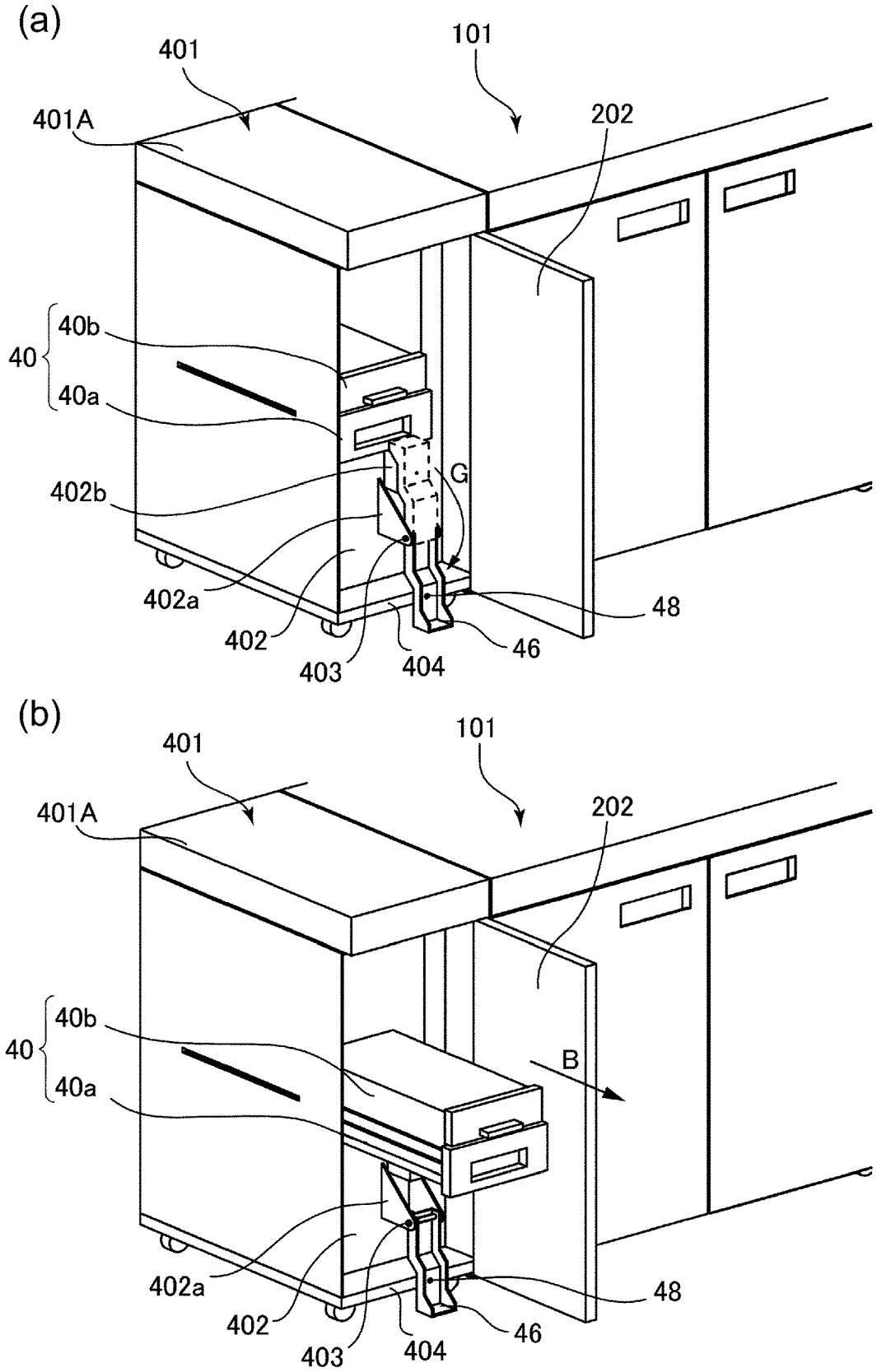

Part (a) of FIG. 10 is a perspective view showing how a fixing member is rotated, and part (b) of FIG. 10 is a perspective view showing a decurl device with a decurl device unit drawn out.

Figure 11:
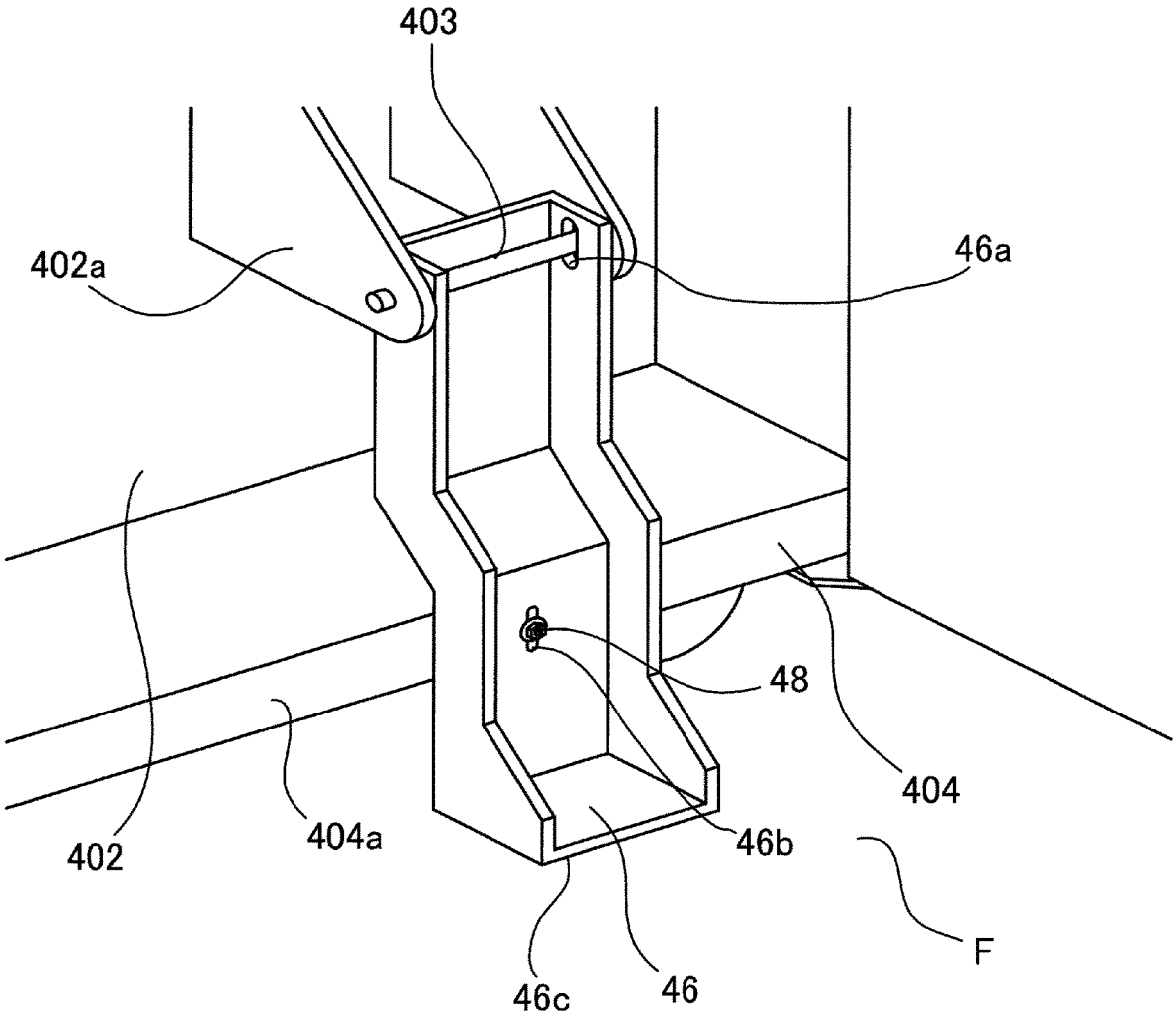

FIG. 11 is a perspective view showing a fixing member in a tip resistant position.

DESCRIPTION OF EMBODIMENTS

First Embodiment

Overall Structure

Figure 1:
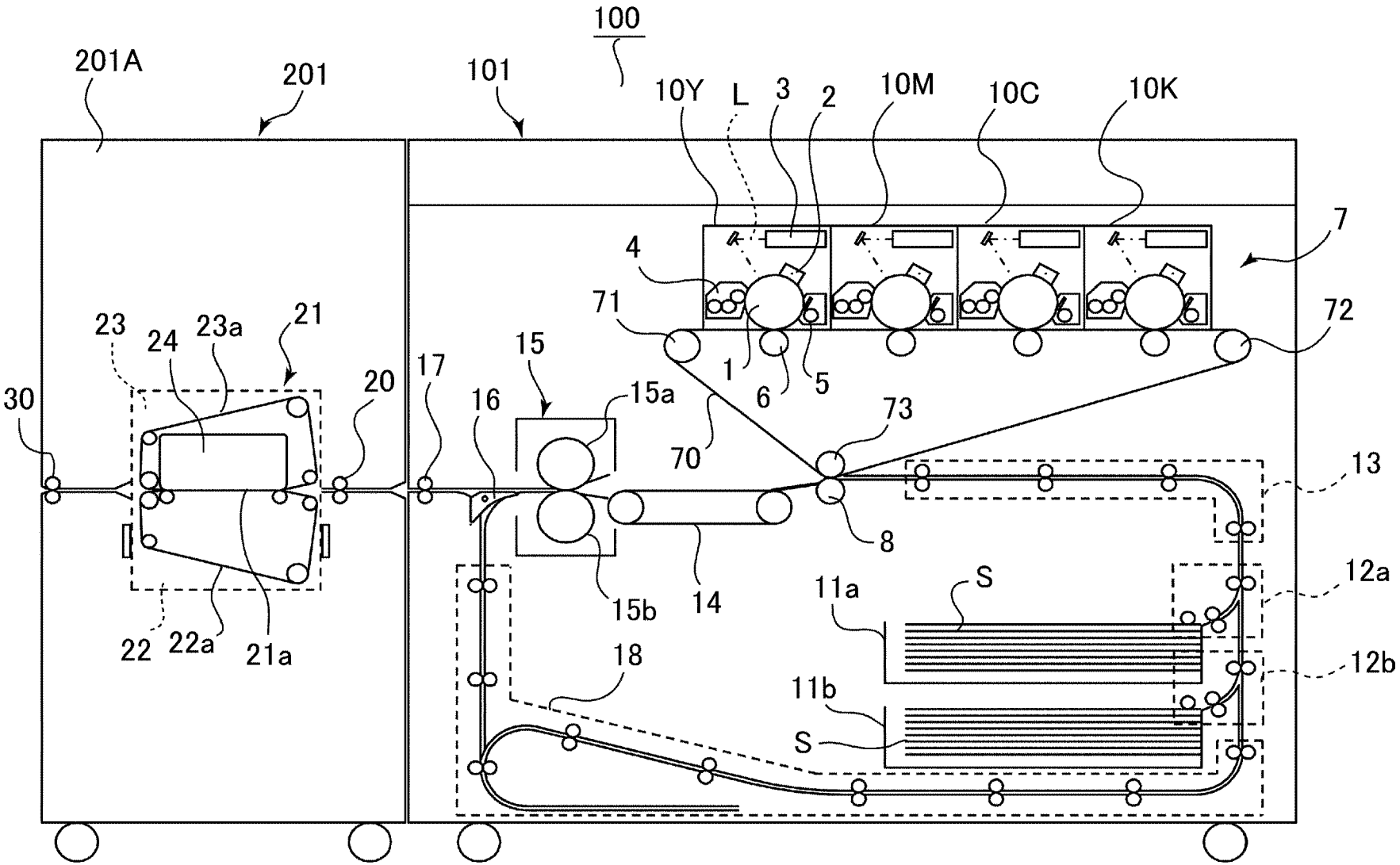
FIG. 1 is an overall schematic view showing an image forming system of a first embodiment of the present invention.

As shown in FIG. 1, an image forming system 100 of a first embodiment has a printer 101, which is a full-color laser printer of an intermediate transfer tandem method with an intermediate transfer belt 70, and a cooling device 201 connected to a printer 101.

The printer 101 as an image forming apparatus forms a toner image on a sheet S based on the image signal input from an information terminal such as a personal computer or an external device such as an image reader. The printer 101 can be used for a variety of sheets as recording media, including paper and envelopes, glossy paper, plastic film such as overhead projector sheets, and cloth.

The printer 101 has a sheet feeding system, which will be described later, and an image forming portion 7. The image forming portion 7 includes four process units 10Y, 10M, 10C, and 10K that form yellow, magenta, cyan, and black toner images, and an intermediate transfer belt 70 that is an intermediate transfer body. The process units 10Y to 10K are electrophotographic units each having a photosensitive drum.

Since the process units 10Y to 10K are similarly configured except for the color of toner used for development, the configuration of the process unit and the toner image forming process (image forming operation) will be explained using the yellow process unit 10Y as an example. The process unit 10Y has a charger 2, a laser exposure device 3, a developer 4, and a drum cleaner 5 in addition to the photosensitive drum 1. The photosensitive drum 1 is a drum-shaped photoreceptor having a photosensitive layer on its outer periphery and rotates along the direction of rotation of the intermediate transfer belt 70. The surface of the photosensitive drum 1 is charged by being supplied with electric charge from the charger 2.

The laser exposure device 3 emits a laser beam L modulated according to the image information and scans the photosensitive drum 1 via mirrors and other devices as appropriate to draw an electrostatic latent image on the surface of the photosensitive drum 1. The developer 4 accommodates a developer containing toner and develops the electrostatic latent image into a toner image by supplying toner to the photosensitive drum 1. The toner image formed on the photosensitive drum 1 is primary transferred to the intermediate transfer belt 70 in the primary transfer portion, which is the nip portion between a primary transfer roller 6 and the intermediate transfer belt 70. The residual toner remaining on the photosensitive drum 1 after transfer is removed by the drum cleaner 5 and collected in the toner tank (not shown).

The intermediate transfer belt 70 is wound around rollers 71 and 72, and a secondary transfer inner roller 73, etc., and is rotationally driven. Wherein said image forming operations are carried out in parallel in each of the process units 10Y to 10K, and the toner images of the four colors are multiply transferred so that they overlap each other, forming a full-color toner image on the intermediate transfer belt 70. This toner image is carried on the intermediate transfer belt 70 and fed to the secondary transfer portion. The secondary transfer portion is configured as a nip portion between a secondary transfer roller 8 and the secondary transfer inner roller 73 as the transfer portion, and the toner image is secondarily transferred to the sheet S by applying a bias voltage of the opposite polarity of the toner charge to the secondary transfer roller 8. The residual toner remaining on the intermediate transfer belt 70 after transfer is removed by the belt cleaner.

The Sheet S on which the toner image has been transferred is passed to a fixing device 15 by a pre-fixing transport portion 14. The fixing device 15 has a fixing roller pair 15*a* and 15*b* that nips and feeds the sheet S, and a heat source such as a halogen heater, and applies pressure and heat to the toner image carried on the sheet S. This causes the toner particles to melt and adhere to the sheet S, resulting in a fixed image that is fixed to the sheet S.

The configuration and operation of the sheet feeding system that feeds the sheet S and discharges the sheet S on which an image has been formed to the cooling device 201 will be described. The sheet feeding system roughly includes feeding portions 12*a*, 12*b*, a registration feeding portion 13, a discharge roller pair 17, the pre-fixing transport portion 14, and a duplex transport portion 18.

The feeding portions 12*a* and 12*b* feed the sheets S from cassettes 11*a* and 11*b*, respectively, which contain the sheets S. The feeding portions 12*a* and 12*b* separate the sheets one by one and transport the sheets S to the registration feeding portion 13.

The sheet S fed from the feed portions 12*a* and 12*b* is corrected for skewness in the registration transport portion 13. Then, the sheet S is transported by the registration transport portion 13 to synchronize with the transfer timing in the secondary transfer portion. The sheet S, on which the toner image has been transferred in the secondary transfer portion and the image has been fixed by the fixing device 15, is transported along the sheet S feeding pass to a pass switching portion 16. When image formation on the sheet S has been completed, the sheet S is fed by the pass switching portion 16 to the discharge roller pair 17 and is discharged by the discharge roller pair 17 to the cooling unit 201.

In case an image is formed on the back side of the sheet S, the sheet S is fed to the registration transfer portion 13 by the duplex transfer portion 18. The sheet S is then discharged to the cooling device 201 after the image is formed on the back side.

Cooling Device

A cooling device 201 as a sheet cooling device has a main assembly 201A as a support frame, and a cooling unit 21 as a draw out unit that can be drawn out in the draw out direction (drawing direction) B (see FIG. 6) with respect to the main assembly 201A. The draw out direction B is a direction from the back side to the front side of the cooling device 201. The main assembly 201A supports an entrance roller pair 20 and an exit roller pair 30, which feed a sheet S. The cooling unit 21 consists of a lower unit 22 equipped with a lower feeding belt 22*a*, and an upper unit 23 equipped with an upper feeding belt 23*a* and a heat sink 24. The heat sink 24 contacts the inner surface side of the upper feeding belt 23*a*.

The sheet S received from the discharge roller pair 17 of the printer 101 to the cooling device 201 is fed to the cooling unit 21 by the entrance roller pair 20. The sheet S is cooled as it passes through the nip feeding passage 21*a* formed by the lower feeding belt 22*a* and the upper feeding belt 23*a*, and is discharged by the exit roller pair 30.

The configuration of the cooling unit 21 will be described specifically. As shown in FIG. 2(*a*), the lower unit 22 has a lower unit frame 22*b*, and suspension rollers of the lower feeding belt 22*a* are rotatably supported on the lower unit frame 22*b*. Similarly, the upper unit 23 has an upper unit frame 23*b*, and the upper unit frame 23*b* rotatably supports the suspension rollers of the upper feeding belt 23*a* and the heat sink 24.

The lower unit frame 22*b* and the upper unit frame 23*b* have a lower unit hinge portion 22*c* and an upper unit hinge portion 23*c*, respectively. The lower unit hinge portion 22*c* and the upper unit hinge portion 23*c* are rotatably connected to each other via a hinge shaft portion 29.

The lower unit 22 has a latch shaft 22*d*, and the upper unit 23 has a hook member 23*d* which is engageable with the latch shaft 22*d*, and a release lever 25 which is linked to the hook member 23*d*. The upper unit 23 is fixed to the lower unit 22 by the hook member 23*d* engaging the latch shaft 22*d* with the lower feeding belt 22*a* and the upper feeding belt 23*a* forming a nip. To open the nip feeding pass 21*a*, the user releases the engagement of the hook member 23*d* with the latch shaft 22*d* by operating the release lever 25, and rotates the upper unit 23 upward as shown in FIG. 2(*b*).

As shown in FIG. 3(*a*), the cooling device 201 has a door 202 that can be opened and closed from the main assembly 201A. The door 202 is movable between a closing position, which covers the cooling unit 21 mounted on the main assembly 201A, and an opening position, which exposes the cooling unit 21 to the outside of the cooling device 201 and allows the cooling unit 21 to be drawn out of the main assembly 201A.

The lower unit 22 of the cooling unit 21 is supported so that it can be drawn out along rails 204 and 205 attached to the frame of the main assembly 201A. The cooling unit 21 is fixed to the main assembly 201A by the fixing member 26 as a restricting member while it is mounted on the main assembly 201A. The fixing member 26 is fixed to the lower unit frame 22*b* and the rail 204 by screws 27*a* and 27*b*, respectively, as shown in FIG. 3(*b*). FIG. 3(*b*) is an enlarged perspective view of the portion enclosed by the dashed line A in FIG. 3(*a*).

For example, when a sheet S is jammed in the nip feeding passage 21*a*, the user can rotate the upper unit 23 upward against the lower unit 22 while the cooling unit 21 is fixed to the main assembly 201A, as shown in FIG. 4. This opens the nip feeding passage 21A and allows the user to remove the sheet S jammed in the nip feeding passage 21A.

Maintenance of Cooling Unit

When performing maintenance on the cooling unit 21, the user or service person (hereinafter referred to simply as the user) draws the cooling unit 21 out of the main assembly 201A and performs maintenance work. The maintenance work includes, for example, the replacement of the upper feeding belt 23*a*, lower feeding belt 22A, etc.

First, the user opens the door 202 from the closing position to the opening position to expose the cooling unit 21, as shown in FIGS. 5(*a*) and (*b*). Next, the user removes the fixing member 26 that fixes the lower unit 22 of the cooling unit 21, and fixes the fixing member 26 to a bottom plate 206 of the main assembly 201A. The bottom plate 206 opposes to the floor surface F, and a distance d1 between the fixing member 26 in the tip resistant position described below and the floor surface F is set to be shorter than a distance d2 between the bottom plate 206 and the floor surface F. The cooling device 201 is supported on the floor surface F by a plurality of casters 35 supported by the bottom plate 206.

The fixing member 26 has a slotted hole 26*a* extending in the vertical direction and a grounding portion 26*b* opposed to the floor surface F of the cooling device 201. The fixing member 26 is fixed to a front surface 206*a* of the bottom plate 206 in the tip resistant position by fixing a screw 28 penetrating the slotted hole 26*a* to the bottom plate 206. The fixing member 26 in the tip resistant position is located on the front side of the cooling device 201, that is, downstream of the bottom plate 206 in the draw out direction B.

The fixing member 26 can adjust the height by adjusting the position of the screw 28 that penetrates the slotted hole 26*a*, and is preferably fixed to the bottom plate 206 so that the grounding portion 26*b* is grounded to the floor surface F as the installation surface where the cooling device 201 is installed. In other words, the slotted hole 26*a* as the adjustment portion adjusts the position of the fixing member 26 to the floor surface F. In this way, by structuring the fixing member 26 to be capable of adjusting the height, the grounding portion 26*b* of the fixing member 26 can be securely grounded to the floor surface F even if, for example, the floor surface F is uneven or undulating. The screw holes of the fixing member 26 may be round holes provided in such a position that the distance between the bottom surface of the bottom plate 206 (the surface opposed to the floor F) and the installation portion 26*b* is d2. If the structure can prevent the cooling device 201 from tipping when the cooling unit 21 is drawn out, it may have a structure that it is fixed to the bottom plate 206 such that a gap is formed between the installation portion 26*b* of the fixing member 26 and the floor surface F. In this case, if the gap between the installation portion 26*b* and the floor surface F is about 5 mm, the cooling device 201 can prevent from tipping.

The user draws out the cooling unit 21 to a given position in the draw out direction B and performs maintenance of the cooling unit 21, as shown in FIG. 6. As the cooling unit 21 is moved in the draw out direction B, the cooling device 201 is subjected to an increased moment C that prompts the cooling device 201 to tip to downstream side in the draw out direction B, that is, to the front side of the device. The fixing member 26 supports the moment C, that is, the load of the cooling device 201, by contacting the floor surface F downstream side from the main assembly 201A of the cooling device 201 in the draw out direction B, and functions as a tip resistant member to prevent the cooling device 201 from tipping.

The fixing member 26 can be positioned in the restricted position as the first position shown in FIG. 3(*a*), and in the tip resistant position as the second position shown in FIGS. 5(*a*) and (*b*). In other words, the fixing member 26 is detachably supported to the main assembly 201A of the cooling device 201. In the restricted position, the fixing member 26 restricts the cooling unit 21 from being drawn out of the main assembly 201A, and it is opposed to the floor surface F in the tip resistant position. The tip resistant position is a position lower than the restricted position.

The fixing member 26 is a component that must be removed from the restricted position before drawing the cooling unit 21 from the main assembly 201A of the cooling device 201 in the maintenance workflow of the cooling unit 21. Therefore, when performing maintenance on the cooling unit 21, the user necessarily remove the fixing member 26 from the restricted position. The removed fixing member 26 can be attached to the bottom plate 206 in the tip resistant position in the workflow to prevent the tipping of the cooling device 201.

When the maintenance work of the cooling unit 21 is completed, the user inserts the cooling unit 21 into the main assembly 201A in the mounting position and reattaches the fixing member 26 in the tip resistant position to the restricted position.

FIG. 7 shows a plan view of the state in which the fixing member 26 is installed in the tip resistant position. If the fixing member 26 is left fixed in the tip resistant position, the door 202 interferes with the fixing member 26 and cannot be closed to the closed position. That is, with the fixing member 26 in the tip resistant position interfering with the door 202, the distance between the tip 202*a* of the door 202 and the front surface 206*a* of the bottom plate 206 is a distance E. The distance E is greater than a distance D between the door 202 and the front surface 206*a* in the closed position. In other words, the fixing member 26 overlaps the movement trajectory of the door 202 when it moves between the open position and the closed position in the tip resistant position. It is of course true that the fixing member 26 does not overlap the movement path of the door 202 when it moves between the open and closed positions in the restricted position.

The cooling system 201 has a detection unit (not shown) that detects the opening and closing of the door 202, and when the door 202 is in a position other than the closed position, i.e., when the door 202 is open, the operation of the cooling system 201 is prohibited as well as being informed by an informing unit (not shown). The informing unit includes, for example, an operation portion that can display various settings and messages, and a warning unit that warns the user by light and sound. This prevents the user from forgetting to return the fixing member 26 from the tip resistant position to the restricting position.

As described above, since the fixing member 26 must always be removed from the restricting position before drawing out the cooling unit 21 from the main assembly 201A of the cooling device 201, the user cannot forget to remove the fixing member 26 from the restricting position when maintaining the cooling unit 21. And since the user is sure to recognise the removed fixing member 26, forgetting to set the fixing member 26 to the tip resistant position can be reduced, thereby reducing the tipping of the cooling device 201.

Second Embodiment

Next, the second embodiment of the present invention will be described. The second embodiment is configured by applying a decurl device 401 instead of the cooling device 201 of the first embodiment and by changing the method of moving the fixing member. For this reason, the same configuration as that of the first embodiment will be omitted from the figure or described with the same references in the figure.

As shown in FIG. 8, the image forming system 300 of this embodiment has a printer 101 and a decurl device 401 connected to the printer 101. The sheet S on which an image has been formed in the printer 101 is discharged by the discharge roller pair 17 to the decurl device 401, and the curl is corrected in the decurl device 401.

Decurl Device

Next, the decurl device 401 will be described in detail. The decurl device 401 as a sheet feeding device has a main body 401A and a decurl unit 40 as a draw out unit that can be drawn out in the draw out direction B (see FIG. 9(*a*)) with respect to the main body 401A. The draw out direction B is a direction from the back side to the front side of the decurl unit 401. The decurl unit 40 has an entering roller pair 41 and an exiting roller pair 44 that convey the sheet S, and decurl roller pairs 42, 43 that correct the curl of the sheet S.

The decurl roller pair 42 has a sponge roller 42*a* and a hard roller 42*b*, and the decurl roller pair 43 has a sponge roller 43*a* and a hard roller 43*b*. The outer diameters of the sponge rollers 42*a* and 43*a* are larger than the outer diameters of the hard rollers 43*b* and 43*b*, which are made of metallic materials, for example.

The sponge rollers 42*a*, 43*a* are located on opposite sides of the feeding path 51, and similarly, the hard rollers 43*b*, 43*b* are also located on opposite sides of the feeding path 51. For this reason, the direction of the curl corrected by the decurl roller pair 42 and the direction of the curl corrected by the decurl roller pair 43 are in opposite directions. The decurl unit 40 has a nip pressure changing unit (not shown) that changes the nip pressure of the decurl roller pairs 42, 43 according to the size and direction of the curl of the sheet S.

Each roller pair and the surrounding feed guide of the decurl unit 40 are divided into a lower unit 40*a* and an upper unit 40*b*, bordered by the feeding path 51. The lower unit 40*a* and the upper unit 40*b* are freely rotatable and connected to each other via a hinge (not shown). The lower unit 40*a* is slidable (withdrawable) and supported against the frame 402 of the main assembly 401A via slide rails 45*a*, 45*b*.

As shown in FIG. 9(*a*), the main assembly 401A has a supporting portion 402*a* provided on the frame 402, a fulcrum shaft 403 provided on the support portion 402*a*, and a fixed member 46 that is rotatable and supported against the support portion 402*a* around the fulcrum shaft 403.

The fixing member 46 as a restricting member can be positioned in a restricting position as the first position shown in FIG. 9(*a*) and in a tip resistant position as the second position shown in FIG. 10(*b*). In the restricting position, the fixing member 46 restricts the decurl unit 40 from being drawn out of the main assembly 401A, and in the tip resistant position, it faces the floor surface F. The tip resistant position is a lower position than the restricting position.

The fixing member 46 is fixed by screw 47 to the fixing portion 402*b* on the frame 402 in the restricting position. As a result, in a state in which the decurl unit 40 is mounted on the main assembly 401A, its withdrawal from the main assembly 401A is restricted.

For example, when sheet S gets jammed in the feeding path 51, the user can rotate the upper unit 40*b* upward with respect to the lower unit 40*a* while the decurl unit 40 is positioned in the main assembly 401A, as shown in FIG. 9(*b*). This opens the feeding path 51 and allows the user to remove the sheet S jammed in the feeding path 51.

Maintenance of the Decurl Unit

On the other hand, when performing maintenance on the decurl unit 40, the user pulls the decurl unit 40 out of the main device 401A to perform the maintenance work. First, the user opens the door 202 from the closed position to the open position to expose the decurl unit 40, as shown in FIG. 10(*a*). Next, the user removes the screw 47 that secures the fixing member 46 in the restricted position, and rotates the fixing member 46 from the restricted position to the tip resistant position in the direction of arrow G.

The fixing member 46 has a long hole 46*a* through which the fulcrum shaft 403 penetrates, a long hole 46*b* through which the screw 48 can penetrate, and a grounding portion 46*c* facing the floor surface F, as shown in FIG. 11. The long holes 46*a* and 46*b* extend in the vertical direction when the fixing member 46 is in the tip resistant position. The fixing member 46 is fixed at the tip resistant position to the front surface 404*a* of the bottom plate 404 by fixing the screw 48 penetrating the long hole 46*b* to the bottom plate 404 of the decurl device 401. The fixing member 46 is located at the front side of the decurl device 401, that is, at the downstream side in the drawer direction B. The bottom plate 404 faces the floor surface F. The distance between the fixed member 46 in the tip resistant position and the floor surface F is set to be shorter than the distance between the bottom plate 404 and the floor surface F.

The fixing member 46 is height-adjustable by adjusting the position of the fixing member 46 relative to the fulcrum shaft 403, and is preferably fixed to the bottom plate 404 so that the grounding portion 46*c* is grounded to the floor surface F. In other words, the long hole 46*a* as an adjustment part through which the fulcrum shaft 403 penetrates adjusts the position of the fixed member 46 relative to the floor surface F. In this way, by configuring the fixing member 46 to be height-adjustable, the grounding portion 46*c* of the fixing member 46 can be securely grounded against the floor surface F even if, for example, the floor surface F is uneven or undulating.

Next, the user draws out the decurl unit 40 to a predetermined position in the pull-out direction B and performs maintenance on the decurl unit 40, as shown in FIG. 10(*b*). Here, as the decurl unit 40 moves in the pull-out direction B, the decurl device 401 has an increased moment C that encourages it to tip down-stream in the pull-out direction B, that is, to the front side of the device. The fixed member 46 contacts the floor surface F downstream from the main assembly 401A of the decurl unit 401 in the pull-out direction B. By contacting the floor surface F, the fixed member 46 supports the moment C, i.e., the load of the decurl device 401, and functions as a tip resisting member that prevents the decurl device 401 from tipping over.

When the maintenance work of the decurl unit 40 is completed, the user inserts the decurl unit 40 into the mounting position against the device body 401A and positions the fixed member 46, which is in the tip resistant position, in the restricted position again.

As in the first embodiment, the fixed member 46 does not overlap with the movement trajectory of the door 202 when it moves between the open and closed positions in the restricted position, but overlaps with the above movement trajectory of the door 202 in the tip resistant position. This prevents the fixed member 46 from being forgotten to be returned from the tip resistant position to the restricted position.

As described above, the fixing member 46 must be rotated from the restricted position to the tip resistant position before drawing out the decurl unit 40 from the main unit 401A. And since the user surely recognises the fixed member 46 that has been rotated, forgetting to set the fixed member 46 to the tip resistant position can be reduced, and the tipping of the decurl unit 401 can be reduced.

Since the fixed member 46 is supported to be rotatable around the fulcrum shaft 403, it can be easily moved between the restricted position and the tip resistant position, which improves maintainability. In addition, even if the fixing member 46 is moved between the restricted position and the tip resistant position, the fixing member 46 will not be lost.

Other Embodiments

In both embodiments already described, it is preferable that the fixing members 26, 46 are grounded to the floor surface F at the tip resistant position, but this is not limited to this. For example, there may be a gap between the fixing members 26, 46 and the floor surface F, as long as the cooling device 201 or the decurl device 401 can be prevented from tipping over. In this case, if the gap between the installation portions 26, 46 and the floor surface F is about 5 mm, the cooling device 201 or the decurl device 401 can be prevented from tipping over.

In the first and second embodiments, the cooling device 201 and the decurl device 401 are described as examples of devices for withdrawing units from the main assembly of the apparatus, but they are not limited to this. For example, the invention may be applied to a device that is configured to be drawn out from the main assembly of the apparatus and equipped with a stacker or cassette for storing sheets. It is also optional which of the fixing members 26 and 46 is applied to which device. For example, the fixing member 46 may be applied to the first embodiment, and the fixing member 26 may be applied to the second embodiment.

In the second embodiment, the fixed member 46 is configured to be pivotable between the restricted position and the tip resistant position. For example, the fixed member 46 may be slidable between the restricted position and the tip resistant position.

In both of the previously described embodiments, the fixing members 26, 46 are fixed by screws, but this is not limited to this. For example, the fixing members 26, 46 may be positioned by snap-fits, magnets, etc.

In both embodiments described above, the cooling device 201 and the decurl device 401 are directly connected to the printer 101, but other devices may be interposed between the cooling device 201, the decurl device 401 and the printer 101.

In all of the embodiments described above, an electrophotographic printer 101 has been used, but the present invention is not limited to this. For example, the present invention can be applied to an image forming system having an image forming apparatus of the inkjet method, which forms an image on a sheet by ejecting an ink liquid from a nozzle.

According to this invention, forgetting to set the restriction member can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100037 filed on Jun. 9, 2020, which is hereby incorporated by reference herein in its entirety.

What is claimed is:

1. A sheet cooling device comprising:

a main assembly;

a cooling unit, drawable out of said main assembly with respect to a drawing direction, provided with a first belt, a second belt for forming a nip portion with said first belt to nip and feed a sheet and a heatsink in contact with an inner peripheral surface of said first belt; and a restricting member configured to be positionable in a first position where said cooling unit is restricted from drawing out of said main assembly and in a second position lower than the first position where said restricting member opposes to an installation surface on which said sheet cooling device is installed.

2. A sheet cooling device according to claim 1, wherein said restricting member receives a load of said sheet cooling device by contacting the installation surface.

3. A sheet cooling device according to claim 1, wherein said restricting member includes an adjusting portion for adjusting a position of said restricting member to the installation surface.

4. A sheet cooling device according to claim 1, further comprising a door openable and closable to said main assembly, wherein said door is movable between a closing position where said drawer unit mounted to said main assembly is closed and an opening position where said drawer unit is exposed and is permitted to be drawn out of said main assembly, and wherein said restricting member overwraps in the second position with a moving locus between the opening position and the closing position of said door.

5. A sheet cooling device according to claim 1, wherein said main assembly includes a bottom plate opposing to the installation surface, and wherein said restricting member is fixed to said bottom plate in the second position.

6. A sheet cooling device according to claim 5, wherein a distance between said restricting member in the second position and the installation surface is shorter than a distance between said bottom plate and the installation surface.

7. A sheet cooling device according to claim 1, wherein said restricting member is detachably supported to said main assembly.

8. A sheet cooling device according to claim 1, wherein said restricting member is rotatably supported to said main assembly between the first position and the second position.

9. An image forming system comprising:

an image forming apparatus configured to form an image on a sheet; and a sheet cooling device according to claim 1.

* * * * *